US011177558B2

(12) United States Patent
Krogerus et al.

(10) Patent No.: US 11,177,558 B2
(45) Date of Patent: Nov. 16, 2021

(54) APPARATUS AND METHODS FOR WIRELESS COMMUNICATION

(71) Applicant: Nokia Technologies Oy, Espoo (FI)

(72) Inventors: Joonas Krogerus, Espoo (FI); Ruiyuan Tian, Espoo (FI)

(73) Assignee: NOKIA TECHNOLOGIES OY, Espoo (FI)

( * ) Notice: Subject to any disclaimer, the term of this patent is extended or adjusted under 35 U.S.C. 154(b) by 0 days.

(21) Appl. No.: 14/905,903

(22) PCT Filed: Jul. 7, 2014

(86) PCT No.: PCT/FI2014/050562

§ 371 (c)(1),
(2) Date: Jan. 18, 2016

(87) PCT Pub. No.: WO2015/007952

PCT Pub. Date: Jan. 22, 2015

(65) Prior Publication Data

US 2016/0164169 A1 Jun. 9, 2016

(30) Foreign Application Priority Data

Jul. 19, 2013 (GB) ..... 1312904

(51) Int. Cl.
*H01Q 1/24* (2006.01)
*H01Q 7/00* (2006.01)
(Continued)

(52) U.S. Cl.
CPC ..... *H01Q 1/243* (2013.01); *H01Q 1/48* (2013.01); *H01Q 5/307* (2015.01); *H01Q 7/00* (2013.01); *H01Q 13/10* (2013.01); *H01Q 21/28* (2013.01)

(58) Field of Classification Search
CPC ..... H01Q 1/243; H01Q 5/307; H01Q 1/48; H01Q 7/00; H01Q 13/10; H01Q 21/28
See application file for complete search history.

(56) References Cited

U.S. PATENT DOCUMENTS 3,046,551 A * 7/1962 Ratkevich ..... H01Q 19/17 343/778
7,639,203 B2 12/2009 Hao
(Continued)

FOREIGN PATENT DOCUMENTS

CN 101682119 A 3/2010
CN 102710817 A 10/2012
(Continued)

OTHER PUBLICATIONS

International Search Report and Written Opinion received for corresponding Patent Cooperation Treaty Application No. PCT/FI2014/050562, dated Nov. 5, 2014, 14 pages.
(Continued)

*Primary Examiner* — Dimary S Lopez Cruz
*Assistant Examiner* — Bamidele A Jegede
(74) *Attorney, Agent, or Firm* — Alston & Bird LLP

(57) ABSTRACT

An apparatus comprising: a first cover member configured to define an exterior surface of an electronic device, the first cover member including a first conductive portion (30) defining at least a first edge (32) and a second edge (34) of the electronic device, the first edge (32) being shorter than the second edge (34) and defining an aperture (36) therein; a first feed point (26) coupled to the first conductive portion along the first edge (32) at a first side of the aperture (36); and a second feed point (28) coupled to the first conductive portion along the first edge (32) at a second side of the aperture (36), opposite to the first side of the aperture.

27 Claims, 10 Drawing Sheets

(51) Int. Cl.

| | |
|---|---|
| ***H01Q 21/28*** | (2006.01) |
| ***H01Q 5/307*** | (2015.01) |
| ***H01Q 1/48*** | (2006.01) |
| ***H01Q 13/10*** | (2006.01) |

(56) References Cited

U.S. PATENT DOCUMENTS

| | | | | |
|---|---|---|---|---|
| 8,106,836 | B2 | 1/2012 | Hill et al. | |
| 8,188,930 | B2 | 5/2012 | Sung et al. | |
| 8,269,675 | B2 | 9/2012 | Kough et al. | |
| 8,471,768 | B2 | 6/2013 | Wang et al. | |
| 8,489,162 | B1 | 7/2013 | Dou et al. | |
| 8,659,482 | B2 | 2/2014 | Kim et al. | |
| 8,798,554 | B2 | 8/2014 | Darnell et al. | |
| 2004/0257283 | A1 | 12/2004 | Asano et al. | |
| 2006/0145924 | A1* | 7/2006 | Chen | H01Q 1/243 343/700 MS |
| 2007/0120749 | A1 | 5/2007 | Tsai et al. | |
| 2008/0129632 | A1* | 6/2008 | Moon | H01Q 1/243 343/848 |
| 2009/0102742 | A1* | 4/2009 | Park | H01Q 1/2266 343/876 |
| 2009/0284420 | A1* | 11/2009 | Ma | H01Q 1/243 343/700 MS |
| 2010/0007564 | A1* | 1/2010 | Hill | H01Q 1/243 343/702 |
| 2010/0123632 | A1* | 5/2010 | Hill | H01Q 1/243 343/702 |
| 2010/0123633 | A1* | 5/2010 | Ozden | H01Q 1/243 343/702 |
| 2010/0321255 | A1* | 12/2010 | Kough | H01Q 1/243 343/702 |
| 2011/0012790 | A1* | 1/2011 | Badaruzzaman | H01Q 1/243 343/700 MS |
| 2011/0136447 | A1 | 6/2011 | Pascolini et al. | |
| 2011/0241949 | A1 | 6/2011 | Nickel et al. | |
| 2012/0105286 | A1* | 5/2012 | Rhyu | H01Q 1/243 343/702 |
| 2012/0127038 | A1* | 5/2012 | Kim | H01Q 1/243 343/700 MS |
| 2012/0133572 | A1* | 5/2012 | Hsu | H01Q 21/28 343/893 |
| 2012/0218723 | A1* | 8/2012 | Kwak | H01Q 1/243 361/748 |
| 2012/0262345 | A1* | 10/2012 | Kim | H01Q 1/243 343/702 |
| 2012/0306718 | A1* | 12/2012 | Koyanagi | H01Q 1/243 343/853 |
| 2013/0027254 | A1* | 1/2013 | Korva | H01Q 7/00 343/702 |
| 2013/0050046 | A1* | 2/2013 | Jarvis | H01Q 9/145 343/852 |
| 2013/0057437 | A1 | 3/2013 | Chiu et al. | |
| 2013/0069842 | A1* | 3/2013 | Lee | H01Q 21/28 343/853 |
| 2013/0135158 | A1* | 5/2013 | Faraone | H01Q 1/243 343/702 |
| 2013/0342411 | A1* | 12/2013 | Jung | H01Q 1/243 343/767 |
| 2014/0049432 | A1 | 2/2014 | Hill et al. | |
| 2014/0078008 | A1* | 3/2014 | Kang | H01Q 1/38 343/702 |
| 2014/0132467 | A1* | 5/2014 | Park | H01Q 1/243 343/767 |
| 2014/0139379 | A1* | 5/2014 | Bolin | H01Q 1/243 343/702 |
| 2014/0139380 | A1 | 5/2014 | Ouyang et al. | |
| 2014/0218244 | A1* | 8/2014 | Chang | H01Q 1/243 343/702 |
| 2014/0292590 | A1 | 10/2014 | Yoo et al. | |
| 2014/0327584 | A1* | 11/2014 | Chang | H01Q 5/378 343/702 |
| 2016/0056531 | A1* | 2/2016 | Lee | H01Q 7/00 343/702 |
| 2016/0079652 | A1* | 3/2016 | Gu | H01Q 5/371 343/702 |
| 2016/0164169 | A1 | 6/2016 | Krogerus et al. | |
| 2016/0198027 | A1* | 7/2016 | Li | H01Q 9/0421 455/575.1 |
| 2016/0344439 | A1* | 11/2016 | Seol | H01Q 1/243 |

FOREIGN PATENT DOCUMENTS

| | | | |
|---|---|---|---|
| CN | 103066374 | A | 4/2013 |
| CN | 202977704 | U | 6/2013 |
| EP | 1287587 | A1 | 3/2003 |
| EP | 2081257 | A1 | 7/2009 |
| EP | 2405534 | A1 | 1/2012 |
| EP | 2557630 | A1 | 2/2013 |
| EP | 2562870 | A1 | 2/2013 |
| JP | 20050167619 | A | 6/2005 |
| JP | 2006527941 | A | 12/2006 |
| JP | 2014 200088 | A | 10/2014 |
| JP | 6000298 | B2 | 9/2016 |
| JP | 6234566 | B2 | 11/2017 |
| WO | WO 01/91235 | A1 | 11/2001 |
| WO | 2012/008946 | A1 | 1/2012 |
| WO | 2012/140882 | A1 | 10/2012 |
| WO | WO 2014/098889 | A1 | 6/2014 |

OTHER PUBLICATIONS

Deepika et al., "Internal Coupled-fed Antenna forGSM/UMTS/LTE Operation for Tablet Computer", International Journal of Communications and Engineering, vol. 2, No. 2, Mar. 2012, pp. 94-99.

Lau et al., "A Patch Antenna with a Rectangular-loop Feed", IEEE Transactions on Antennas and Propagation, vol. 51, No. 9, Sep. 2003, pp. 2464-2468.

Search Report received for corresponding United Kingdom Patent Application No. 1312904.4, dated Nov. 28, 2013, 8 pages.

Extended European Search Report received for corresponding European Patent Application No. 14826577.0, dated Feb. 20, 2017, 7 pages.

Office action received for corresponding Japanese Patent Application No. 2016-526668, dated Apr. 6, 2017, 2 pages of office action and 2 pages of translation available.

Office Action for corresponding Chinese Patent Application No. 201480050411.X, dated Jun. 20, 2017, 12 pages.

Office Action for Chinese Application No. 201480050411X dated Apr. 10, 2018, 10 pages.

Ban, Y-L, et al., *Decoupled Planar WWAN Antennas with T-shaped Protruded Ground for Smartphone Applications*, IEEE Antennas and Wireless Propagation Letters, vol. 13 (2014) 483-486.

Cihangir, A., *Antenna Designs Using Matching Circuits for 4G Communication Devices*, HAL Archives-Ouvertes (Apr. 2014) 144 pages.

Sonkki, M. et al., *Performance Comparison of a Symmetrical Folded Dipole Antenna for Mobile Terminals and Its Metal Bezel Extension*, 6th European Conference on Antennas and Propagation (EUCAP) (2011) 1913-1916.

Sonkki, M. et al., *User Effect Comparison Between Metal Bezel Antenna and Planar Inverted F-Antenna for Mobile Terminal*, Microwave and Optical Technology Letters , vol. 55, No. 2 (Feb. 2013) 316-322.

Wong, K-L. et al., *Decoupled WWAN/LTE Antennas with an Isolation Ring Strip Embedded Therebetween for Smartphone Application*, Microwave and Optical Technology Letters, vol. 55, No. 7 (Jul. 2013) 1470-1476.

Zhong, J. et al., *Multiband Slot Antennas for Metal Back Cover Mobile Handsets*, Progress in Electromagnetics Research Letters, vol. 39 (2013) 115-126.

Office Action for Chinese Application No. 201480050411X dated Nov. 30, 2018, 9 pages.

Office Action for Indonesian Application No. P00201601055 dated Dec. 17, 2018, 3 pages.

(56) References Cited

OTHER PUBLICATIONS

Office Action for Chinese Application No. 201910419706.4 dated Jun. 19, 2020.
Office Action for Chinese Application No. 201910419706.4 dated Sep. 23, 2020, 7 pages.

* cited by examiner

APPARATUS AND METHODS FOR WIRELESS COMMUNICATION

RELATED APPLICATION

This application was originally filed as Patent Cooperation Treaty Application No. PCT/FI2014/050562 filed Jul. 7, 2014 which claims priority benefit to GB Patent Application 1312904.4 filed Jul. 19, 2013.

TECHNOLOGICAL FIELD

Embodiments of the present invention relate to apparatus and methods for wireless communication. In particular, they relate to apparatus for wireless communication in electronic devices.

BACKGROUND

Apparatus, such as electronic devices, may include an antenna arrangement to enable the electronic device to wirelessly communicate with other devices. The antenna arrangement is usually provided within a cover of the electronic device to shield the antenna arrangement from damage caused by the environment and from contact with the user.

The cover of the electronic device defines the exterior surface of the electronic device and may at least partly comprise a metal or any other conductive material. Such a cover is relatively strong and may have an attractive aesthetic appearance. The conductive material of the cover may be utilised as part of the antenna arrangement. However, contact with the user and/or external objects may reduce the efficiency of the antenna arrangement or may prevent the antenna arrangement from operating.

It would therefore be desirable to provide an alternative apparatus.

BRIEF SUMMARY

According to various, but not necessarily all, embodiments of the invention there is provided an apparatus comprising: a first cover member configured to define an exterior surface of an electronic device, the first cover member including a first conductive portion defining at least a first edge and a second edge of the electronic device, the first edge being shorter than the second edge and defining an aperture therein; a first feed point coupled to the first conductive portion along the first edge at a first side of the aperture; and a second feed point coupled to the first conductive portion along the first edge at a second side of the aperture, opposite to the first side of the aperture.

The apparatus may further comprise a first conductive elongate member. The first feed point may be coupled to the first conductive portion via the first conductive elongate member.

The apparatus may further comprise a second conductive elongate member. The second feed point may be coupled to the first conductive portion via the second conductive elongate member.

The apparatus may further comprise a printed wiring board including a ground member. The first feed point and the second feed point may be located on the printed wiring board.

The apparatus may further comprise tuner circuitry coupled to the first feed point and located adjacent the first feed point on the printed wiring board.

The ground member and the second edge of the first conductive portion may define a first slot there between. The first slot may have an open end adjacent the first edge of the first conductive portion, and a closed end, opposite the open end, the first slot having a first length.

The ground member and a third edge of the first conductive portion may define a second slot there between. The second slot may have an open end adjacent the first edge of the first conductive portion, and a closed end, opposite the open end, the second slot having a second length.

The first conductive portion may be configured to form a bezel for the electronic device.

The aperture defined by the first edge may be the only aperture in the bezel.

The first conductive portion may further define a fourth edge of the electronic device. The fourth edge may be shorter than the second edge and may define an aperture therein. The apparatus may further comprise a third feed point coupled to the first conductive portion along the fourth edge at a first side of the aperture of the fourth edge; and may also further comprise a fourth feed point coupled to the first conductive portion along the fourth edge at a second side of the aperture of the fourth edge, opposite to the first side of the aperture of the fourth edge.

The apparatus may further comprise a second cover member configured to define an exterior surface of the electronic device. The second cover member may include a second conductive portion. The first conductive portion and the second conductive portion may define a slot there between. The slot may have an electrically open end adjacent the first edge and a closed end opposite the open end.

The second cover member may be configured to form a rear cover of the electronic device.

The apparatus may further comprise a third cover member configured to define an exterior surface of the electronic device. The third cover member may include a third conductive portion. The first conductive portion and the third conductive portion may define a slot there between. The slot may have an electrically open end adjacent the first edge and a closed end opposite the open end.

The third cover member may be configured to form a front cover of the electronic device.

According to various, but not necessarily all, embodiments of the invention there is provided an electronic device comprising an apparatus as described in any of the preceding paragraphs.

According to various, but not necessarily all, embodiments of the invention there is provided a method comprising: providing a first cover member configured to define an exterior surface of an electronic device, the first cover member including a first conductive portion defining at least a first edge and a second edge of the electronic device, the first edge being shorter than the second edge and defining an aperture therein; coupling a first feed point to the first conductive portion along the first edge at a first side of the aperture; and coupling a second feed point to the first conductive portion along the first edge at a second side of the aperture, opposite to the first side of the aperture.

The method may further comprise providing a first conductive elongate member. The first feed point may be coupled to the first conductive portion via the first conductive elongate member.

The method may further comprise providing a second conductive elongate member. The second feed point may be coupled to the first conductive portion via the second conductive elongate member.

The method may further comprise providing a printed wiring board including a ground member, and locating the first feed point and the second feed point on the printed wiring board.

The method may further comprise coupling tuner circuitry to the first feed point, the tuner circuitry being located adjacent the first feed point on the printed wiring board.

The ground member and the second edge of the first conductive portion may define a first slot there between. The first slot may have an open end adjacent the first edge of the first conductive portion, and a closed end, opposite the open end, the first slot having a first length.

The ground member and a third edge of the first conductive portion may define a second slot there between. The second slot may have an open end adjacent the first edge of the first conductive portion, and a closed end, opposite the open end, the second slot having a second length.

The first conductive portion may be configured to form a bezel for the electronic device.

The aperture defined by the first edge may be the only aperture in the bezel.

The first conductive portion may further define a fourth edge of the electronic device. The fourth edge may be shorter than the second edge and may define an aperture therein. The method may further comprise: coupling a third feed point to the first conductive portion along the fourth edge at a first side of the aperture of the fourth edge; and coupling a fourth feed point to the first conductive portion along the fourth edge at a second side of the aperture of the fourth edge, opposite to the first side of the aperture of the fourth edge.

The method may further comprise providing a second cover member configured to define an exterior surface of the electronic device. The second cover member may include a second conductive portion. The first conductive portion and the second conductive portion may define a slot there between. The slot may have an electrically open end adjacent the first edge and a closed end opposite the open end.

The second cover member may be configured to form a rear cover of the electronic device.

The method may further comprise providing a third cover member configured to define an exterior surface of the electronic device. The third cover member may include a third conductive portion. The first conductive portion and the third conductive portion may define a slot there between. The slot may have an electrically open end adjacent the first edge and a closed end opposite the open end.

The third cover member may be configured to form a front cover of the electronic device.

BRIEF DESCRIPTION

For a better understanding of various examples that are useful for understanding the brief description, reference will now be made by way of example only to the accompanying drawings in which.

DETAILED DESCRIPTION

Figure 1:
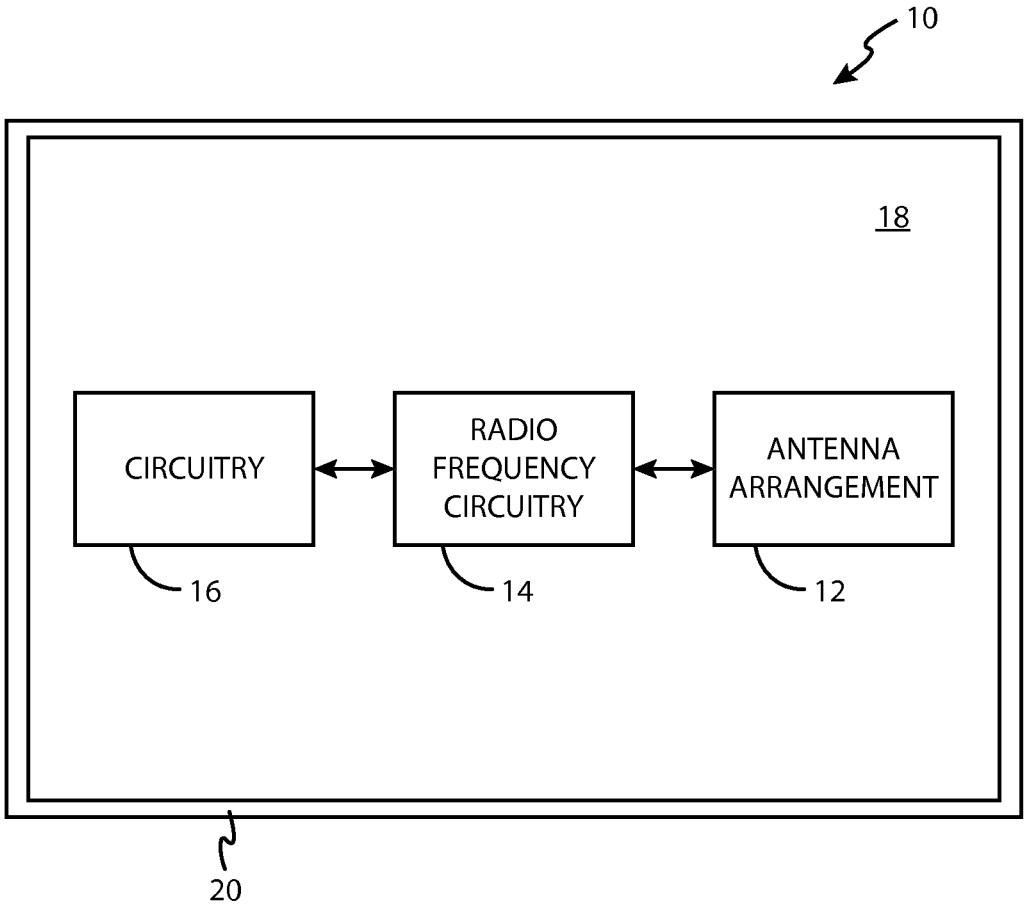
FIG. 1 illustrates a schematic diagram of an electronic device according to various examples.

In the following description, the wording 'connect' and 'couple' and their derivatives mean operationally connected or coupled. It should be appreciated that any number or combination of intervening components can exist (including no intervening components). Additionally, it should be appreciated that the connection or coupling may be a physical galvanic connection and/or an electromagnetic connection.

Also, where a feature is described as being conductive, this should be understood to mean that the feature comprises a conductive material such as a metal or a conductive polymer. Where a feature is described as being non-conductive, this should be understood to mean that the feature comprises a non-conductive material such as a plastic.

FIGS. 2, 3, 4, 5 and 6 illustrate an apparatus 22, 52, 64, 74, 84, 104, 108, 112 comprising: a first cover member 24 configured to define an exterior surface of an electronic device 10, the first cover member 24 including a first conductive portion 30 defining at least a first edge 32 and a second edge 34 of the electronic device 10, the first edge 32 being shorter than the second edge 34 and defining an aperture 36 therein; a first feed point 26 coupled to the first conductive portion 30 along the first edge 32 at a first side of the aperture 36; and a second feed point 28 coupled to the first conductive portion 30 along the first edge 32 at a second side of the aperture 36, opposite to the first side of the aperture 36.

FIG. 1 illustrates an electronic device 10 which may be any apparatus such as a hand portable electronic device (for example, a mobile cellular telephone, a tablet computer, a laptop computer, a personal digital assistant or a hand held computer), a non-portable electronic device (for example, a personal computer or a base station for a cellular network), a portable multimedia device (for example, a music player, a video player, a game console and so on) or a module for such devices. As used here, the term 'module' refers to a unit or apparatus that excludes certain parts or components that would be added by an end manufacturer or a user.

The electronic device 10 comprises an antenna arrangement 12, radio frequency circuitry 14, circuitry 16, a ground member 18, and a cover 20.

The antenna arrangement 12 includes one or more antennas that are configured to transmit and receive, transmit only or receive only electromagnetic signals. The radio frequency circuitry 14 is connected between the antenna arrangement 12 and the circuitry 16 and may include a receiver and/or a transmitter and/or a transceiver. The circuitry 16 is operable to provide signals to, and/or receive signals from the radio frequency circuitry 14. The electronic device 10 may optionally include one or more matching circuits, filters, switches, or other radio frequency circuit elements, and combinations thereof, between the antenna arrangement 12 and the radio frequency circuitry 14.

The radio frequency circuitry 14 and the antenna arrangement 12 may be configured to operate in a plurality of operational frequency bands. For example, the operational frequency bands may include (but are not limited to) Long Term Evolution (LTE) (B17 (DL:734-746 MHz; UL:704-716 MHz), B5 (DL:869-894 MHz; UL: 824-849 MHz), B20 (DL: 791-821 MHz; UL: 832-862 MHz), B8 (925-960 MHz; UL: 880-915 MHz) B13 (DL: 746-756 MHz; UL: 777-787 MHz), B28 (DL: 758-803 MHz; UL: 703-748 MHz), B7 (DL: 2620-2690 MHz; UL: 2500-2570 MHz), B38 (2570-2620 MHz), B40 (2300-2400 MHz) and B41 (2496-2690 MHz)), amplitude modulation (AM) radio (0.535-1.705 MHz); frequency modulation (FM) radio (76-108 MHz); Bluetooth (2400-2483.5 MHz); wireless local area network (WLAN) (2400-2483.5 MHz); hiper local area network (HiperLAN) (5150-5850 MHz); global positioning system (GPS) (1570.42-1580.42 MHz); US-Global system for mobile communications (US-GSM) 850 (824-894 MHz) and 1900 (1850-1990 MHz); European global system for mobile communications (EGSM) 900 (880-960 MHz) and 1800 (1710-1880 MHz); European wideband code division multiple access (EU-WCDMA) 900 (880-960 MHz); personal communications network (PCN/DCS) 1800 (1710-1880 MHz); US wideband code division multiple access (US-WCDMA) 1700 (transmit: 1710 to 1755 MHz, receive: 2110 to 2155 MHz) and 1900 (1850-1990 MHz); wideband code division multiple access (WCDMA) 2100 (transmit: 1920-1980 MHz, receive: 2110-2180 MHz); personal communications service (PCS) 1900 (1850-1990 MHz); time division synchronous code division multiple access (TD-SCDMA) (1900 MHz to 1920 MHz, 2010 MHz to 2025 MHz), ultra wideband (UWB) Lower (3100-4900 MHz); UWB Upper (6000-10600 MHz); digital video broadcasting-handheld (DVB-H) (470-702 MHz); DVB-H US (1670-1675 MHz); digital radio mondiale (DRM) (0.15-30 MHz); worldwide interoperability for microwave access (WiMax) (2300-2400 MHz, 2305-2360 MHz, 2496-2690 MHz, 3300-3400 MHz, 3400-3800 MHz, 5250-5875 MHz); digital audio broadcasting (DAB) (174.928-239.2 MHz, 1452.96-1490.62 MHz); radio frequency identification low frequency (RFID LF) (0.125-0.134 MHz); radio frequency identification high frequency (RFID HF) (13.56-13.56 MHz); radio frequency identification ultra high frequency (RFID UHF) (433 MHz, 865-956 MHz, 2450 MHz).

A frequency band over which an antenna can efficiently operate using a protocol is a frequency range where the antenna's return loss is less than an operational threshold. For example, efficient operation may occur when the antenna's return loss is better than (that is, less than) −4 dB or −6 dB.

The circuitry 16 may include processing circuitry, memory circuitry and input/output devices such as an audio input device (a microphone for example), an audio output device (a loudspeaker for example), a display and a user input device (such as a touch screen display and/or one or more buttons or keys).

The antenna arrangement 12 and the electronic components that provide the radio frequency circuitry 14 and the circuitry 16 may be interconnected via the ground member 18 (for example, a printed wiring board). The ground member 18 may be used as a ground plane for the antenna arrangement 12 by using one or more layers of the printed wiring board. The one or more layers of the printed wiring board may not be entirely dedicated as a ground plane so only a portion of one or more layers of the printed wiring board may be utilized as at least a part of the ground plane. In other embodiments, some other conductive part of the electronic device 10 (a battery cover or a chassis within the interior of the cover 20 for example) may be used as the ground member 18 for the antenna arrangement 12. In some examples, the ground member 18 may be formed from several conductive parts of the electronic device 10, one part which may include the printed wiring board. The ground member 18 may be planar or non-planar.

The cover 20 has an exterior surface that defines one or more exterior visible surfaces of the electronic device 10 and also has an interior surface that defines a cavity configured to house the electronic components of the electronic device 10 such as the radio frequency circuitry 14, the circuitry 16 and the ground member 18. As described in greater detail in the following paragraphs, the antenna arrangement 12 includes at least a part of the cover 20.

Figure 2:
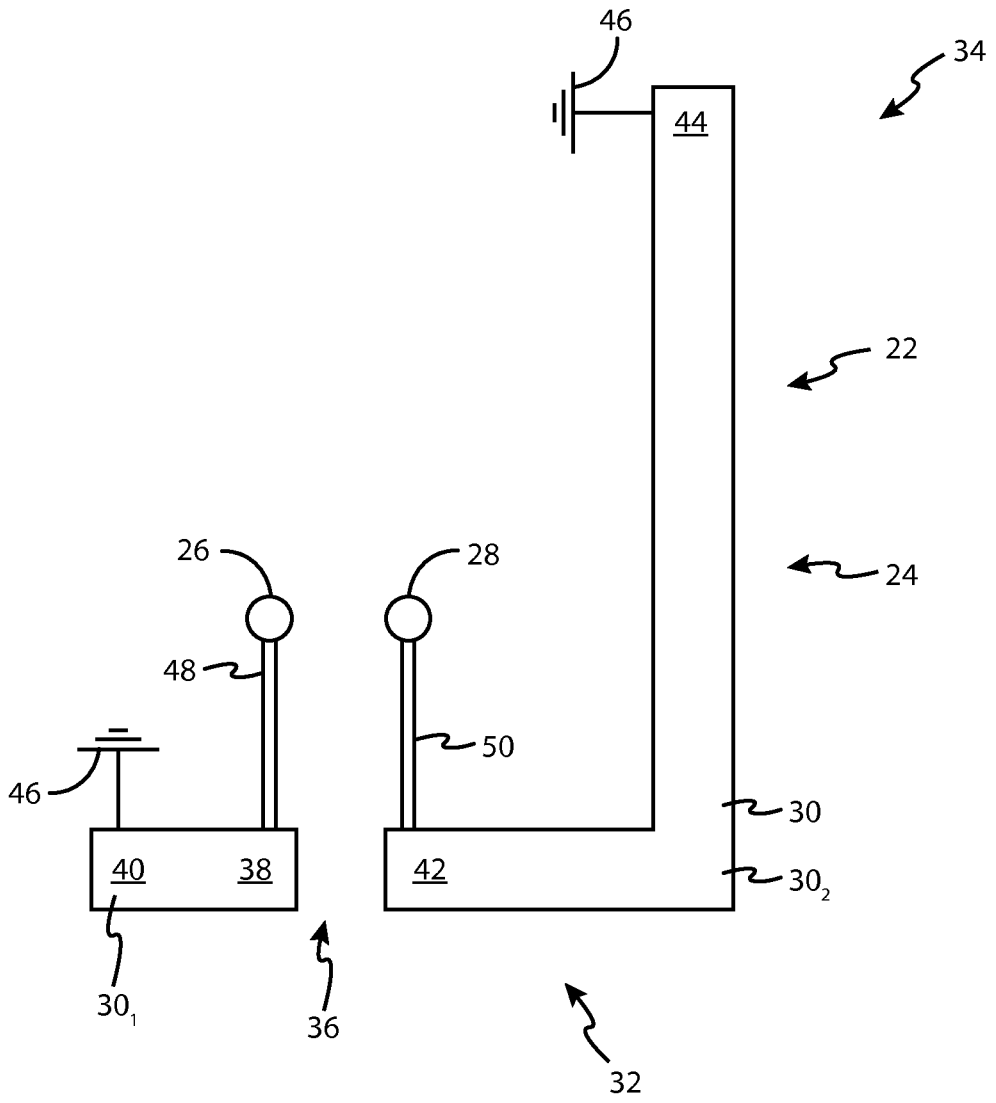
FIG. 2 illustrates a schematic diagram of an apparatus according to various examples.

FIG. 2 illustrates a schematic diagram of an apparatus 22 according to various examples. The apparatus 22 includes a first cover member 24, a first feed point 26, and a second feed point 28.

The first cover member 24 is at least a part of the cover 20 illustrated in FIG. 1 and is configured to define an exterior surface of the electronic device 10 and may be, for example, a bezel of a mobile cellular telephone or tablet computer. The first cover member 24 includes a first conductive portion 30 and may also include other portions (such as a non-conductive coating on the exterior of the first conductive portion 30 for example).

The first conductive portion 30 defines at least a first edge 32 and a second edge 34 of the electronic device 10. The first edge 32 is shorter than the second edge 34 and defines an aperture 36 therein. The aperture 36 may be defined at any location along the first edge 32 and may be formed in the centre of the first edge 32 for example. The electronic device 10 may include circuitry (not illustrated in FIG. 2) within the aperture 36. For example, a universal serial bus (USB) connector may be positioned within the aperture 36 so that the aperture becomes filled with the USB connector.

The aperture 36 may be considered to form a slot in the first edge 32 that separates the first conductive portion 30 into a first part $\mathbf{30}_1$ and a second separate part $\mathbf{30}_2$. The first part $\mathbf{30}_1$ is provided on a first side of the aperture 36 and has a first end 38 adjacent the aperture 36 and a second opposite end 40. The second part $\mathbf{30}_2$ is provided on a second side of the aperture 36 and has a first end 42 adjacent the aperture 36 and a second opposite end 44. The second end 40 of the first part $\mathbf{30}_1$ and the second end 44 of the second part $\mathbf{30}_2$ are connected to ground 46.

In some examples, the second end 40 of the first part $\mathbf{30}_1$ and the second end 44 of the second part $\mathbf{30}_2$ may be connected together so that the first conductive portion 30 forms a ring having an aperture therein. In these examples, the first part $\mathbf{30}_1$ is connected to ground 46 at a location between the first end 38 and the second end 40. Similarly, the second part $\mathbf{30}_2$ is connected to ground 46 at a location between the first end 42 and the second end 44.

The first feed point 26 is coupled to the radio frequency circuitry 14 (illustrated in FIG. 1) to receive signals from the radio frequency circuitry 14 and/or to provide signals to the radio frequency circuitry 14. The first feed point 26 may be directly coupled to the radio frequency circuitry 14 (that is, the coupling does not include any intervening components), or may be coupled to the radio frequency circuitry 14 via one or more components (such as one or more impedance matching networks).

The first feed point 26 is coupled to the first conductive portion 30 along the first edge 32 at the first side of the aperture 36. In various examples, the first feed point 26 is coupled to the first end 38 of the first part $30_1$ via a first conductive elongate member 48. In other examples, the first feed point 26 may not be galvanically connected to the first part $30_1$ and may instead be electromagnetically coupled to the first part $30_1$.

Figure 3:
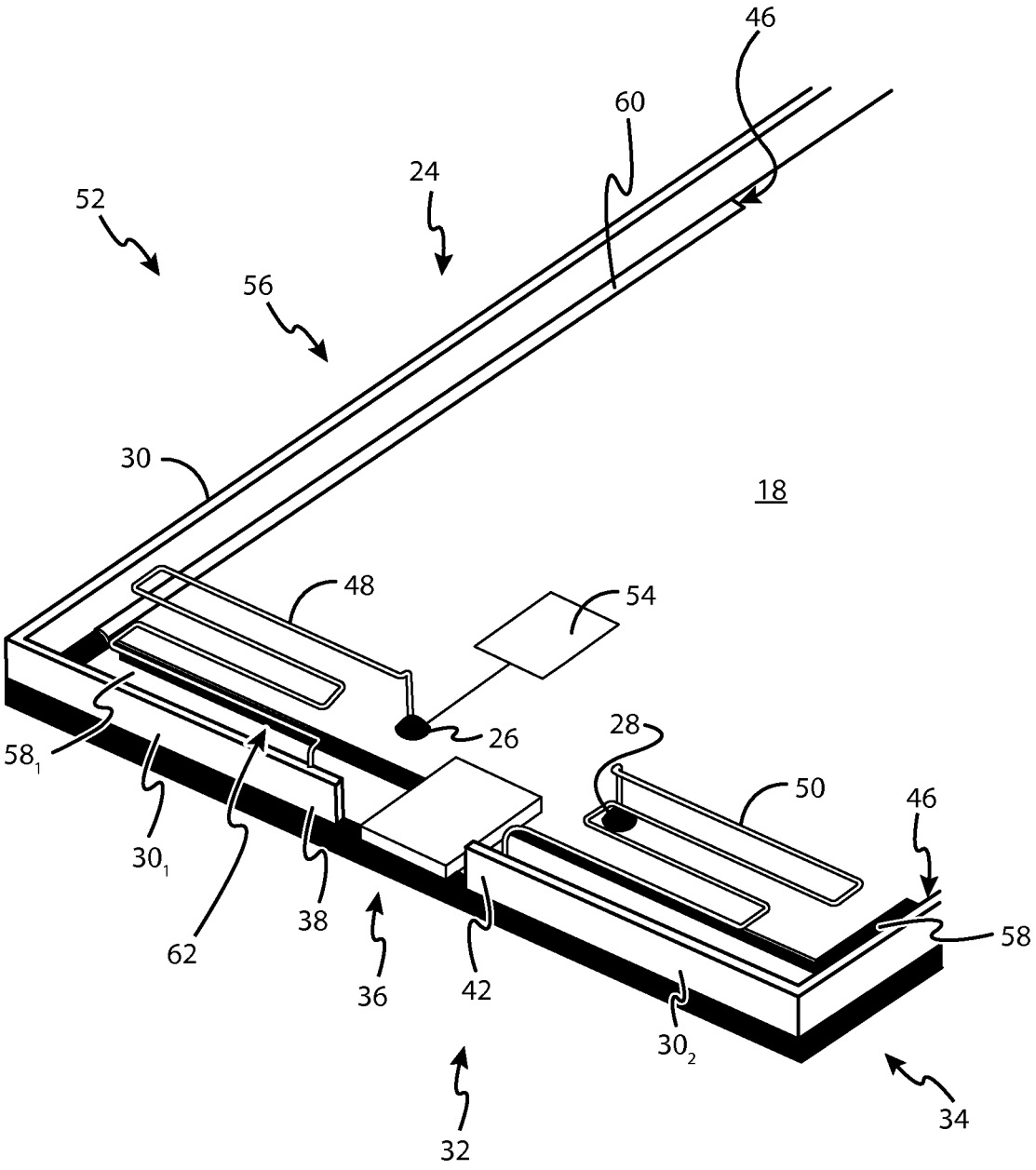
FIG. 3 illustrates a perspective view of another apparatus according to various examples.

The first conductive elongate member 48 may have any suitable shape and may be a meandering strip of metal in some examples (as illustrated in FIG. 3). The first conductive elongate member 48 may include one or more reactive components (such as one or more capacitors and/or one or more inductors).

The second feed point 28 is coupled to the radio frequency circuitry 14 (illustrated in FIG. 1) to receive signals from the radio frequency circuitry 14 and/or to provide signals to the radio frequency circuitry 14. The second feed point 28 may be directly coupled to the radio frequency circuitry 14 (that is, the coupling does not include any intervening components), or may be coupled to the radio frequency circuitry 14 via one or more components (such as one or more matching networks).

The second feed point 28 is coupled to the first conductive portion 30 along the first edge 32 at the second side of the aperture 36. In various examples, the second feed point 28 is coupled to the first end 42 of the second part $30_2$ via a second conductive elongate member 50. In other examples, the second feed point 28 may not be galvanically connected to the second part $30_2$ and may instead be electromagnetically coupled to the second part $30_2$.

The second conductive elongate member 50 may have any suitable shape and may be a meandering strip of metal in some examples (as illustrated in FIG. 3). The second conductive elongate member 50 may include one or more reactive components (such as one or more capacitors and/or one or more inductors).

The first part $30_1$ of the first conductive portion 30 is configured to operate as a first antenna in at least a first operational frequency band (which may be any of the operational frequency bands mentioned in the preceding paragraphs). The first antenna has an electrical length that includes the physical length of the first part $30_1$ and the physical length of the first conductive elongate member 48 (where present) between the first feed point 26 and the connection to ground 46. The first antenna may be considered to form a loop antenna where a first end is connected to the first feed point 26, and a second end is connected to ground 46.

The second part $30_2$ of the first conductive portion 30 is configured to operate as a second antenna in at least a second operational frequency band (which may be any of the operational frequency bands mentioned in the preceding paragraphs and may be the same or different to the first operational frequency band). The second antenna has an electrical length that includes the physical length of the second part $30_2$ and the physical length of the second conductive elongate member 50 (where present) between the second feed point 28 and the connection to ground 46. The second antenna may be considered to form a loop antenna where a first end is connected to the second feed point 28, and a second end is connected to ground 46.

FIG. 3 illustrates a perspective view of an apparatus 52 according to various examples. The apparatus 52 is similar to the apparatus 22 illustrated in FIG. 2, and where the features are similar, the same reference numerals are used. The apparatus 52 differs from the apparatus 22 in that the apparatus 52 further comprises a ground member 18 and tuner circuitry 54. The first feed point 26 and the second feed point 28 are located on a printed wiring board (that may provide the ground member 18 for example).

The first cover member 24 is a bezel of the electronic device 10 and extends around the perimeter of the ground member 18. As illustrated in FIG. 3, the first conductive portion 30 includes the first edge 32, the second edge 34, a third edge 56 and a fourth edge (not illustrated in FIG. 3). The first edge 32 and the fourth edge are parallel to one another, and the second edge 34 and the third edge 56 are parallel to one another. The third edge 56 is longer than the first edge 32 and may have the same length as the second edge 34.

The ground member 18 and the second edge 34 of the first conductive portion 30 define a first slot 58 there between. The first slot has an open end adjacent the first edge 32 of the first conductive portion 30, and a closed end, opposite the open end where the second part $30_2$ of the first conductive portion 30 is grounded to the ground member 18. The first slot 58 has a first length between the open end and the closed end.

The ground member 18 and the third edge 56 of the first conductive portion 30 define a second slot 60 there between. The second slot 60 has an open end adjacent the first edge 32 of the first conductive portion 30, and a closed end, opposite the open end, where the first part $30_1$ of the first conductive portion 30 is grounded to the ground member 18. The second slot 60 has a second length between the open end and the closed end.

The ground member 18 and the first edge 32 of the first conductive portion 30 define a third slot 62 there between. The third slot 62 has an opening to the first slot 58 and also has an opening to the second slot 60.

The electrical length of the first antenna (and hence the at least first operational frequency band) may be selected by providing the second slot 60 with an appropriate length. For example, where it is desired for the first antenna to operate at relatively high frequencies, the second slot 60 may be manufactured to have a relatively short length, thus providing a relatively short electrical length. By way of another example, where it is desired for the first antenna to operate at relatively low frequencies, the second slot 60 may be manufactured to have a relatively long length, thus providing a relatively long electrical length.

The electrical length of the second antenna (and hence the at least second operational frequency band) may be selected by providing the first slot 58 with an appropriate length. For example, where it is desired for the second antenna to operate at relatively high frequencies, the first slot 58 may be manufactured to have a relatively short length, thus providing a relatively short electrical length. By way of another example, where it is desired for the second antenna to operate at relatively low frequencies, the first slot 58 may be manufactured to have a relatively long length, thus providing a relatively long electrical length.

In some examples, the electrical lengths of the first and second antennas may be selected so that the first and second antennas are configured to operate in similar or the same operational frequency band. Consequently, the first and second antennas may be used for Long Term Evolution (LTE) multiple input multiple out (MIMO) operation.

The tuner circuitry 54 is coupled to the first feed point 26 and located adjacent the first feed point 26 on the ground member 18. The tuner circuitry 54 is configured to provide dynamic control of the impedance of the first antenna. The apparatus 52 may also include additional tuner circuitry (not illustrated in FIG. 3) that is coupled to the second feed point 28 and is located adjacent the second feed point 28 on the ground member 18. The additional tuner circuitry is configured to provide dynamic control of the impedance of the second antenna.

Figure 4:
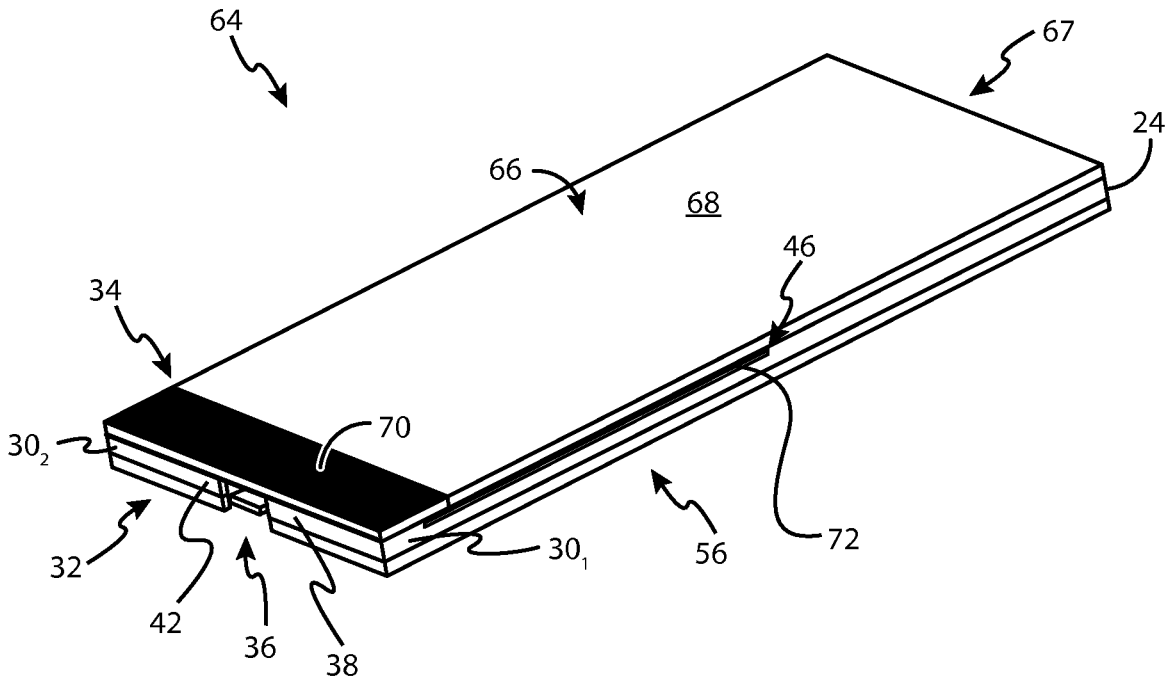
FIG. 4 illustrates a perspective view of a further apparatus according to various examples.

FIG. 4 illustrates a perspective view of an apparatus 64 according to various examples. The apparatus 64 is similar to the apparatus 22 and 52 illustrated in FIGS. 2 and 3, and where the features are similar, the same reference numerals are used.

The apparatus 64 differs from the apparatus 22 and 52 in that the apparatus 64 further comprises a second cover member 66 that is configured to define an exterior surface of the electronic device 10. The second cover member 66 may be a rear cover of the electronic device (as illustrated in FIG. 4). The second cover member 66 overlays the first cover member 24 (that is, the second cover member 66 overlays the first edge 32, the second edge 34, the third edge 56 and a fourth edge 67 of the first conductive portion 30) and is coupled to the first cover member 24.

The second cover member 66 includes a second conductive portion 68 and a non-conductive portion 70. The second conductive portion 68 extends from the fourth edge 67 towards the first edge 32, and the non-conductive portion 70 extends from the first edge 32 towards the fourth edge 67. The second conductive portion 68 has a greater surface area than the non-conductive portion 70.

The second conductive portion 68 is coupled to the ground member 18 and is therefore grounded. The third edge 56 of the first conductive portion 30 and the second conductive portion 68 define a slot 72 there between. The slot 72 has an electrically open end adjacent the first edge 32 and a closed end opposite the open end. The electrically open end of the slot 72 overlaps with the non-conductive portion 70 of the second cover member 66 and consequently, the first conductive portion 30 is grounded to the second conductive portion 68 at the closed end of the slot 72.

The grounding connection between the first conductive portion 30 and the second conductive portion 68 at the closed end of the slot 72 provides a second electrical length for the first antenna and may enable the first antenna to operate in a further operational frequency band. The second electrical length (and hence the further operational frequency band) may be selected by providing the slot 72 with an appropriate length. For example, where it is desired for the first antenna to operate at relatively high frequencies, the slot 72 may be manufactured to have a relatively short length, thus providing a relatively short second electrical length. By way of another example, where it is desired for the first antenna to operate at relatively low frequencies, the slot 72 may be manufactured to have a relatively long length, thus providing a relatively long second electrical length.

In some examples, the second edge 34 of the first conductive portion 30 and the second conductive portion 68 define a slot there between as described above with reference to the slot 72. The slot defined by the second edge 34 and the second conductive portion 68 provides an additional electrical length and may enable the second antenna to operate in a further operational frequency band.

Figure 5:
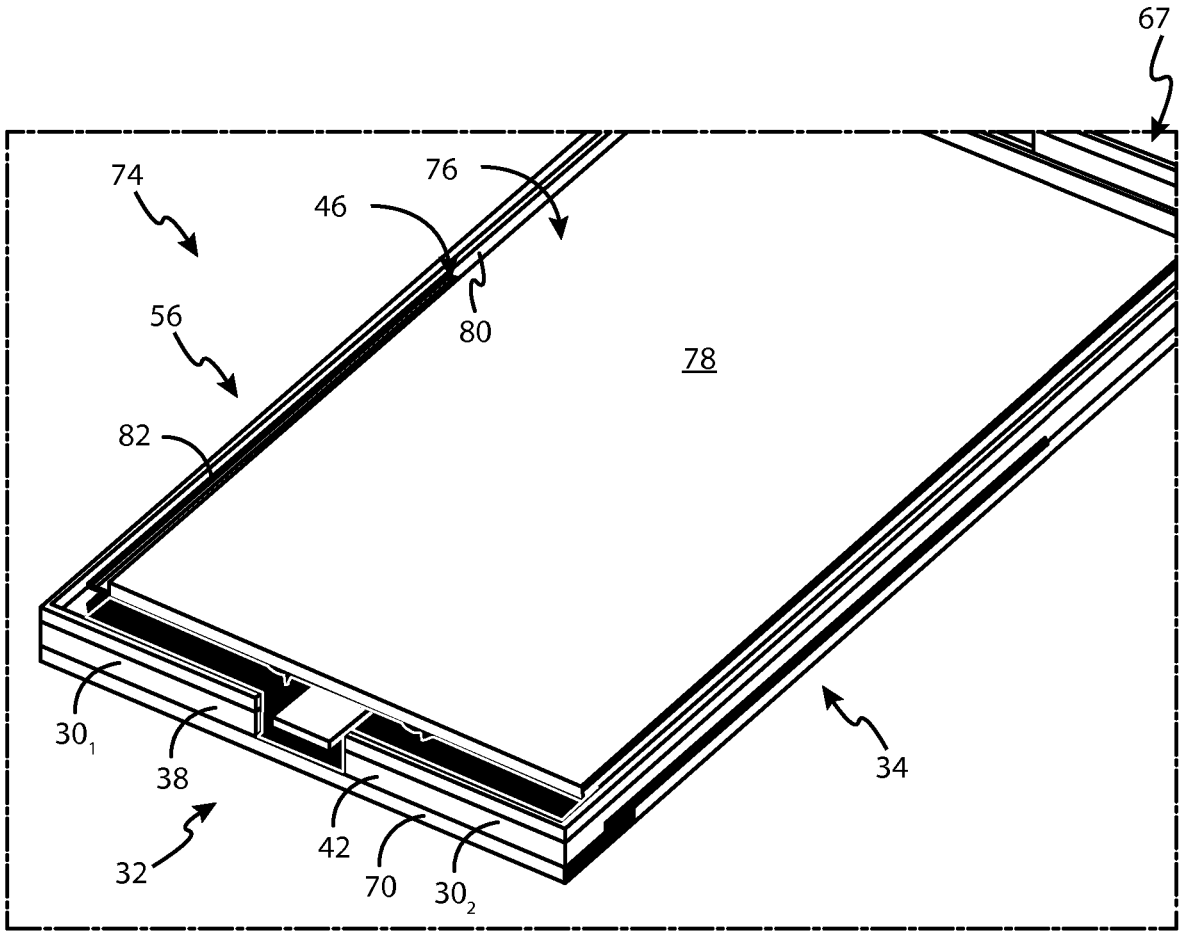
FIG. 5 illustrates a perspective view of another apparatus according to various examples.

FIG. 5 illustrates a perspective view of another apparatus 74 according to various examples. The apparatus 74 is similar to the apparatus 22, 52 and 64 illustrated in FIGS. 2, 3, and 4 respectively and where the features are similar, the same reference numerals are used.

The apparatus 74 differs from the apparatus 22, 52, 64 in that the apparatus 74 further comprises a third cover member 76 that is configured to define an exterior surface of the electronic device 10. For example, the third cover member 76 may be a front cover of the electronic device (as illustrated in FIG. 5) and include a display 78. The third cover member 76 overlays the first cover member 24 (that is, the third cover member 76 overlays the first edge 32, the second edge 34, the third edge 56 and the fourth edge 67 of the first conductive portion 30) and is coupled to the first cover member 24.

The third cover member 76 includes a third conductive portion 80 that extends underneath the display 78 and is coupled to the second edge 34 and to the third edge 56. The third conductive portion 80 is coupled to the ground member 18 and is therefore grounded. The third edge 56 of the first conductive portion 30 and the third conductive portion 80 define a slot 82 there between. The slot 82 has an electrically open end adjacent the first edge 32 and a closed end opposite the open end. Consequently, the first conductive portion 30 is grounded to the third conductive portion 80 at the closed end of the slot 82.

The grounding connection between the first conductive portion 30 and the third conductive portion 80 at the closed end of the slot 82 provides a further electrical length for the first antenna and may enable the first antenna to operate in another operational frequency band. The further electrical length (and hence the further operational frequency band) may be selected by providing the slot 82 with an appropriate length. For example, where it is desired for the first antenna to operate at relatively high frequencies, the slot 82 may be manufactured to have a relatively short length, thus providing a relatively short further electrical length. By way of another example, where it is desired for the first antenna to operate at relatively low frequencies, the slot 82 may be manufactured to have a relatively long length, thus providing a relatively long further electrical length.

In some examples, the second edge 34 of the first conductive portion 30 and the third conductive portion 80 define a slot there between as described above with reference to the slot 82. The slot defined by the second edge 34 and the third conductive portion 80 provides an additional electrical length and may enable the second antenna to operate in a further operational frequency band.

It should be appreciated that the features of the apparatus 22, 52, 64 and 74 may advantageously be combined so that the first antenna is configured to operate in at least three operational frequency bands (provided by the first conductive portion 30 being grounded to the ground member 18, the second conductive portion 68 and the third conductive portion 80). Similarly, the second antenna may be configured to operate in at least three operational frequency bands.

Figure 6:
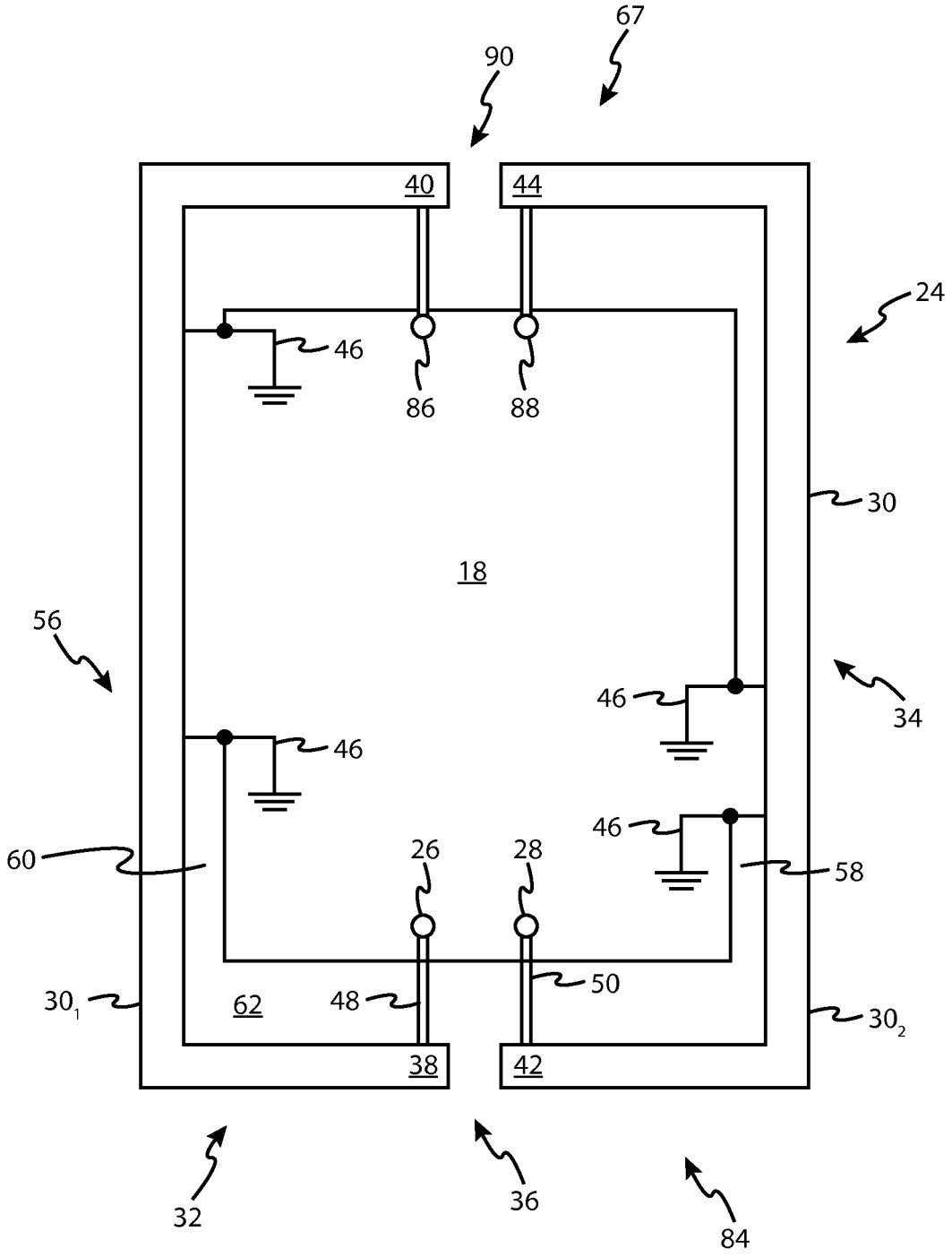
FIG. 6 illustrates a plan view of a further apparatus according to various examples.

FIG. 6 illustrates a plan view of a further apparatus 84 according to various examples. The apparatus 84 is similar to the apparatus 22, 52, 64 and 74 illustrated in FIGS. 2, 3, 4 and 5 respectively and where the features are similar, the same reference numerals are used. The apparatus 84 differs in that the apparatus 84 additionally comprises a third feed point 86 and a fourth feed point 88 positioned adjacent the fourth edge 67 of the first conductive portion 30. Furthermore, the second ends 40, 44 of the first and second parts $\mathbf{30}_1$, $\mathbf{30}_2$ are not coupled together and instead define an aperture 90 in the fourth edge 67 of the first conductive portion 30.

The third feed point 86 is coupled to the first conductive portion 30 along the fourth edge 67 (for example, via a conductive elongate member) at the second end 40 and at a first side of the aperture 90 to form a third antenna. The fourth feed point 88 is coupled to the first conductive portion 30 along the fourth edge 67 (via a conductive elongate member for example) at the second end 44 and at a second side of the aperture 90 to form a fourth antenna. It should be appreciated that in various examples the conductive elongate member may be formed from an integral part of the first conductive portion 30 which extends from an end 38, 42, 40, 44 of the first conductive portion 30 to a feed point 26, 28, 86, 88 respectively.

It should be appreciated that the apparatus 84 may be combined with the apparatus 52, 64 and 74 to enable the third and fourth antennas to advantageously operate in multiple operational frequency bands. For example, the apparatus 84 may have any combination of slots defined between the first conductive portion 30, the ground member 18, the second conductive portion 68 and the third conductive portion 80.

Figure 7:
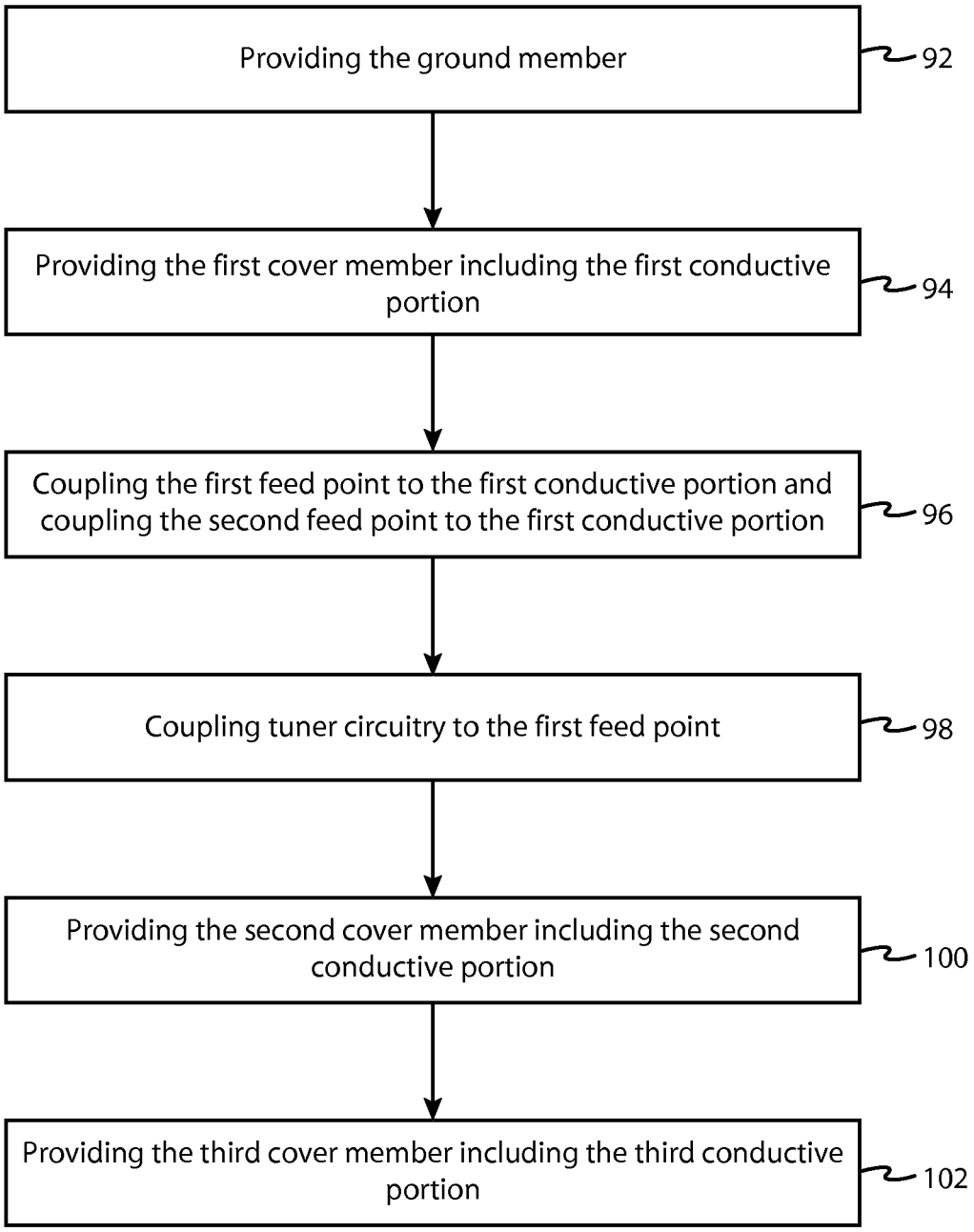
FIG. 7 illustrates a flow diagram of a method of manufacturing an apparatus according to various examples.

FIG. 7 illustrates a flow diagram of a method of manufacturing an apparatus according to various examples. At block 92, the method includes providing the ground member 18.

At block 94, the method includes providing the first cover member 24 including the first conductive portion 30. The aperture 36 (and optionally the aperture 90) may be formed in the first conductive portion 30 by either removing a section of the first conductive portion 30, or by moulding the first conductive portion 30 to include the aperture 36.

At block 96, the method includes coupling the first feed point 26 to the first conductive portion 30 (for example, via the conductive elongate member 48) and coupling the second feed point to the first conductive portion (for example, via the conductive elongate member 50). Block 96 may also include coupling the third and fourth feed points 86, 88 to the first conductive portion 30 (via conductive elongate members for example).

At block 98, the method includes optionally coupling tuner circuitry 54 to the first feed point 26 and positioning the tuner circuitry 54 on the ground member 18. Block 98 may also include optionally coupling additional tuner circuitry to the second feed point 28 and/or the third feed point 86 and/or the fourth feed point 88.

At block 100, the method includes providing the second cover member 66 including the second conductive portion 68. The slot 72 may be formed in the first conductive portion 30 or may be formed in the second conductive portion 68.

At block 102, the method includes providing the third cover member 76 including the third conductive portion 80. The slot 82 may be formed in the first conductive portion 30 or may be formed in the third conductive portion 80.

The blocks illustrated in the FIG. 7 may represent steps in a method and/or sections of code in a computer program. For example, a controller may execute the computer program to control machinery to perform the method illustrated in FIG. 7. The illustration of a particular order to the blocks does not necessarily imply that there is a required or preferred order for the blocks and the order and arrangement of the block may be varied. Furthermore, it may be possible for some blocks to be omitted.

The term 'comprise' is used in this document with an inclusive not an exclusive meaning. That is any reference to X comprising Y indicates that X may comprise only one Y or may comprise more than one Y. If it is intended to use 'comprise' with an exclusive meaning then it will be made clear in the context by referring to "comprising only one . . . " or by using "consisting".

In this brief description, reference has been made to various examples. The description of features or functions in relation to an example indicates that those features or functions are present in that example. The use of the term 'example' or 'for example' or 'may' in the text denotes, whether explicitly stated or not, that such features or functions are present in at least the described example, whether described as an example or not, and that they can be, but are not necessarily, present in some of or all other examples. Thus 'example', 'for example' or 'may' refers to a particular instance in a class of examples. A property of the instance can be a property of only that instance or a property of the class or a property of a sub-class of the class that includes some but not all of the instances in the class.

Figure 8:
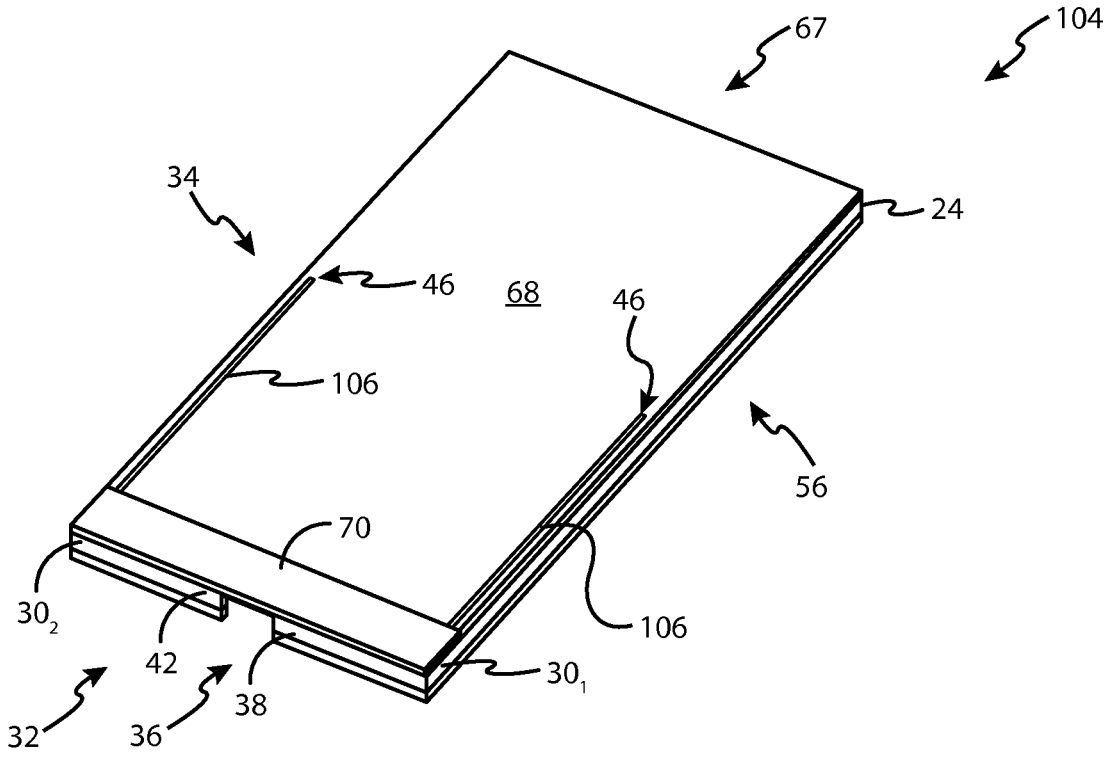
FIG. 8 illustrates a perspective view of a further apparatus according to various examples.

Although embodiments of the present invention have been described in the preceding paragraphs with reference to various examples, it should be appreciated that modifications to the examples given can be made without departing from the scope of the invention as claimed. For example, FIG. 8 illustrates a perspective view of another apparatus 104. The apparatus 104 is similar to the apparatus 64 illustrated in FIG. 4 and where the features are similar, the same reference numerals are used. The apparatus 104 differs from the apparatus 64 in that slots 106 are defined by the upper surface of the second conductive portion 68 instead of by the first conductive portion 30. The slots 106 extend from the non-conductive portion 70 and parallel to the second and third edges 34, 56.

Figure 9:
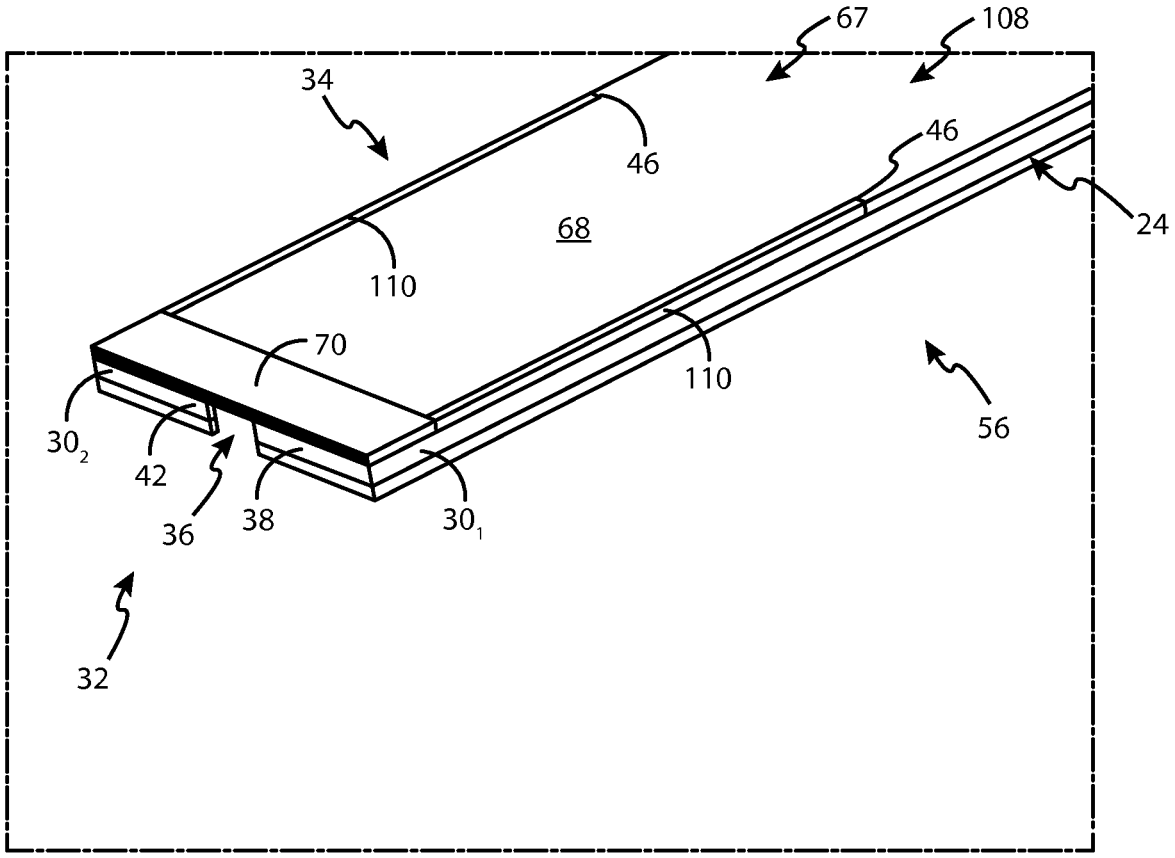
FIG. 9 illustrates a perspective view of another apparatus according to various examples.

FIG. 9 illustrates a perspective view of another apparatus 108. The apparatus 108 is similar to the apparatus 64 and 104 illustrated in FIGS. 4 and 8 respectively and where the features are similar, the same reference numerals are used. The apparatus 108 differs from the apparatus 64 in that slots 110 are defined by the upper surface and the side surfaces of the second conductive portion 68 instead of by the first conductive portion 30. The slots 110 extend from the non-conductive portion 70 and parallel to the second and third edges 34, 56.

Figure 10:
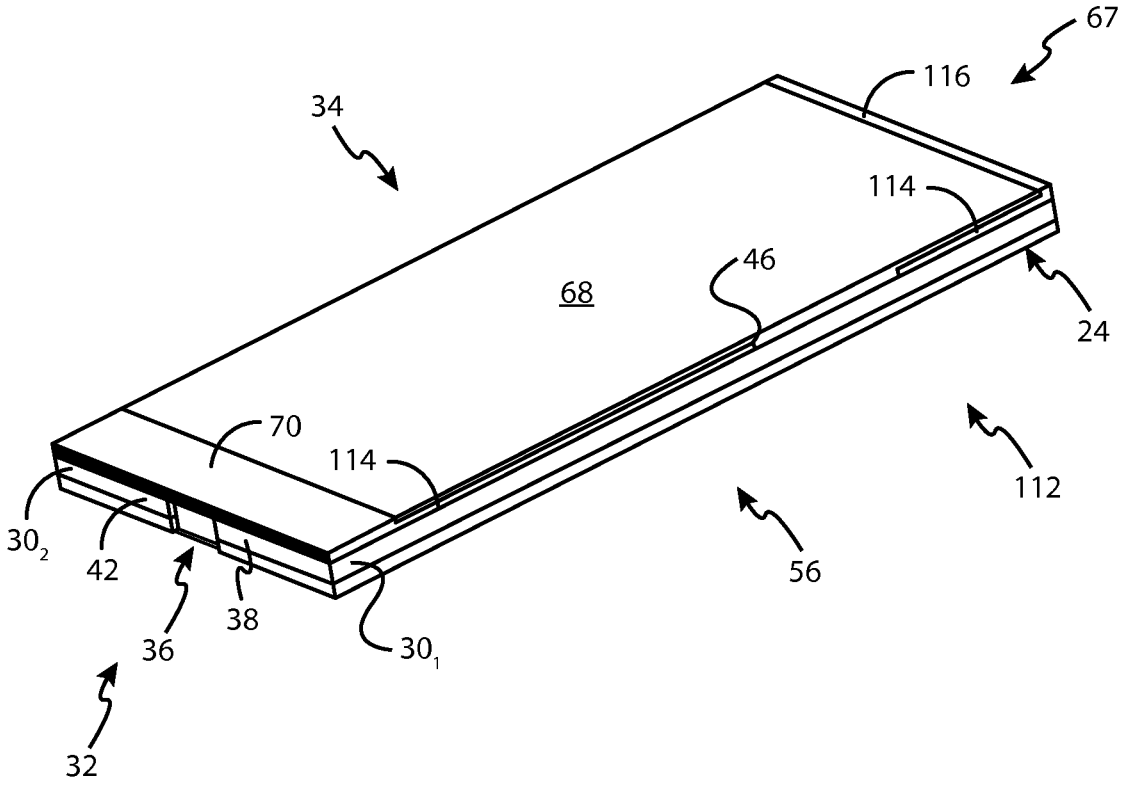
FIG. 10 illustrates a perspective view of a further apparatus according to various examples.

FIG. 10 illustrates a perspective view of a further apparatus 112. The apparatus 112 is similar to the apparatus 64 and 84 illustrated in FIGS. 4 and 6 respectively and where the features are similar, the same reference numerals are used. The apparatus 112 differs from the apparatus 84 in that slots 114 are defined by the side surfaces of the second conductive portion 68 instead of by the first conductive portion 30. The slots 114 extend from the non-conductive portion 70 and a further non-conductive portion 116 (located at the opposite end to the non-conductive portion 70) and parallel to the second and third edges 34, 56.

It should be appreciated that the features of the apparatus 22, 52, 64, 74, 84, 104, 108, 112 may be combined to provide multiple resonances.

The tuner circuitry 54 (and additional tuner circuitry) is optional in the examples described herein. Consequently, an apparatus 22, 52, 64, 74, 84, 104, 108, 112 may, or may not, include tuner circuitry.

In some examples, the slot 72 illustrated in FIG. 4 may extend along the whole of the third edge 56 and a similar slot may extend along the whole of the second edge 34. In these examples, the first conductive portion 30 is grounded to the second conductive portion 68 via connections that are internal to the apparatus 64 (that is, within the cover).

In some examples, the apparatus 64 may not include the slot 72 and instead, the non-conductive portion 70 may extend further down the length of the apparatus 64 so that the first conductive portion $\mathbf{30}_1$ is grounded to the second conductive portion 68 at the interface between the non-conductive portion 70 and the second conductive portion 68.

By way of another example, an apparatus according to various examples may include a non-conductive rear cover and/or a non-conductive front cover.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. An apparatus comprising:

a first cover member configured to define an exterior surface of an electronic device, the first cover member including a first conductive portion defining at least a first edge and a second edge of the electronic device, the first edge defining an aperture therein that separates the first edge into a first part and a second part, wherein the first part is on a first side of the aperture and has a first end adjacent the aperture and a second opposite end and the second part is on a second side of the aperture, opposite the first side, and has a first end adjacent the aperture and a second opposite end;

a first feed point coupled to the first conductive portion along the first edge at the first side of the aperture;

a second feed point coupled to the first conductive portion along the first edge at the second side of the aperture, opposite to the first side of the aperture; and a ground member, wherein the ground member and the second edge of the first conductive portion define a first slot there between, the first slot having an open end adjacent the first edge of the first conductive portion, and a closed end, opposite the open end, at which the second edge is connected to the ground member, the first slot having a first length; and a second cover member configured to define an exterior surface of the electronic device, the second cover member including a second conductive portion and a non-conductive portion, the first conductive portion and the second conductive portion defining a slot there between, the slot having an electrically open end adjacent the first edge and overlapping the non-conductive portion of the second cover member and a closed end opposite the open end.

2. An apparatus as claimed in claim 1, further comprising a first conductive elongate member, wherein the first feed point is coupled to the first conductive portion via the first conductive elongate member.

3. An apparatus as claimed in claim 1, further comprising a second conductive elongate member, wherein the second feed point is coupled to the first conductive portion via the second conductive elongate member.

4. An apparatus as claimed in claim 1, further comprising a printed wiring board including the ground member, wherein the first feed point and the second feed point are located on the printed wiring board.

5. An apparatus as claimed in claim 1, further comprising tuner circuitry coupled to the first feed point and located adjacent the first feed point on the printed wiring board ground member, wherein the first part is configured to operate as a first antenna, and wherein the tuner circuitry is configured to provide dynamic control of the impedance of the first antenna.

6. An apparatus as claimed in claim 1, wherein the first conductive portion is configured to form a bezel for the electronic device.

7. An apparatus as claimed in claim 6, wherein the aperture defined by the first edge is the only aperture in the bezel.

8. An apparatus as claimed in claim 1, wherein the first conductive portion further defines a fourth edge of the electronic device, the fourth edge being shorter than the second edge and defining an aperture therein;

a third feed point coupled to the first conductive portion along the fourth edge at a first side of the aperture of the fourth edge; and a fourth feed point coupled to the first conductive portion along the fourth edge at a second side of the aperture of the fourth edge, opposite to the first side of the aperture of the fourth edge.

9. An apparatus as claimed in claim 1, wherein the second cover member is configured to form a rear cover of the electronic device.

10. An apparatus as claimed in claim 1, further comprising a third cover member configured to define an exterior surface of the electronic device, the third cover member including a third conductive portion, the first conductive portion and the third conductive portion defining a slot there between, the slot having an electrically open end adjacent the first edge and a closed end opposite the open end.

11. An apparatus as claimed in claim 10, wherein the third cover member is configured to form a front cover of the electronic device.

12. An apparatus as claimed in claim 1, wherein the ground member and the first edge of the first conductive portion define a third slot there between, the third slot having an opening to the first slot.

13. An apparatus as claimed in claim 1, wherein the first part is configured to operate as a loop antenna comprising a first antenna end connected to the first feed point and a second antenna end connected to ground.

14. An electronic device comprising:

a first cover member configured to define an exterior surface of the electronic device, the first cover member including a first conductive portion defining at least a first edge and a second edge of the electronic device, the first edge defining an aperture therein that separates the first edge into a first part and a second part, and wherein the first part is on a first side of the aperture and has a first end adjacent the aperture and a second opposite end and the second part is on a second side of the aperture, opposite the first side, and has a first end adjacent the aperture and a second opposite end;

a first feed point coupled to the first conductive portion along the first edge at the first side of the aperture;

a second feed point coupled to the first conductive portion along the first edge at the second side of the aperture, opposite to the first side of the aperture; and a ground member, wherein the ground member and the second edge of the first conductive portion define a first slot there between, the first slot having an open end adjacent the first edge of the first conductive portion, and a closed end, opposite the open end, at which the second edge is connected to the ground member, the first slot having a first length; and a second cover member configured to define an exterior surface of the electronic device, the second cover member including a second conductive portion and a non-conductive portion, the first conductive portion and the second conductive portion defining a slot there between, the slot having an electrically open end adjacent the first edge and overlapping the non-conductive portion of the second cover member and a closed end opposite the open end.

15. An apparatus as claimed in claim 1, wherein the ground member and a third edge of the first conductive portion define a second slot there between, the second slot having an open end adjacent the first edge of the first conductive portion, and a closed end, opposite the open end, the second slot having a second length.

16. An electronic device as claimed in claim 14, wherein the ground member and the first edge of the first conductive portion define a third slot there between, the third slot having an opening to the first slot.

17. An electronic device as claimed in claim 14, further comprising a third cover member configured to define an exterior surface of the electronic device, the third cover member including a third conductive portion, the first conductive portion and the third conductive portion defining a slot there between, the slot having an electrically open end adjacent the first edge and a closed end opposite the open end.

18. An electronic device as claimed in claim 14, wherein the first part is configured to operate as a loop antenna comprising a first antenna end connected to the first feed point and a second antenna end connected to ground.

19. An electronic device as claimed in claim 14, wherein the ground member and a third edge of the first conductive portion define a second slot there between, the second slot having an open end adjacent the first edge of the first conductive portion, and a closed end, opposite the open end, the second slot having a second length.

20. A method comprising:

providing a first cover member configured to define an exterior surface of an electronic device, the first cover member including a first conductive portion defining at least a first edge, and a second edge of the electronic device, the first edge defining an aperture therein that separates the first edge into a first part and a second part, wherein the first part is on a first side of the aperture and has a first end adjacent the aperture and a second opposite end and the second part is on a second side of the aperture, opposite the first side, and has a first end adjacent the aperture and a second opposite end;

coupling a first feed point to the first conductive portion along the first edge at the first side of the aperture;

coupling a second feed point to the first conductive portion along the first edge at the second side of the aperture, opposite to the first side of the aperture; and defining a first slot between a ground member and the second edge of the first conductive portion, the first slot having an open end adjacent the first edge of the first conductive portion, and a closed end, opposite the open end, at which the second edge is connected to the ground member, the first slot having a first length; and providing a second cover member configured to define an exterior surface of the electronic device, the second cover member including a second conductive portion and a non-conductive portion, the first conductive portion and the second conductive portion defining a slot there between, the slot having an electrically open end adjacent the first edge and overlapping the non-conductive portion of the second cover member and a closed end opposite the open end.

21. A method as claimed in claim 20, further comprising providing a first conductive elongate member, wherein the first feed point is coupled to the first conductive portion via the first conductive elongate member.

22. A method as claimed in claim 20, further comprising providing a second conductive elongate member, wherein the second feed point is coupled to the first conductive portion via the second conductive elongate member.

23. An electronic device as claimed in claim 14, further comprising tuner circuitry coupled to the first feed point and located adjacent the first feed point on the ground member, wherein the first part is configured to operate as a first antenna, and wherein the tuner circuitry is configured to provide dynamic control of the impedance of the first antenna.

24. A method as claimed in claim 20, wherein the first part is configured to operate as a first antenna, wherein the method further comprises coupling tuner circuitry to the first feed point to provide dynamic control of the impedance of the first antenna, and wherein the tuner circuitry is located adjacent the first feed point on the ground member.

25. A method as claimed in claim 20, further comprising providing a third cover member configured to define an exterior surface of the electronic device, the third cover member including a third conductive portion, the first conductive portion and the third conductive portion defining a slot there between, the slot having an electrically open end adjacent the first edge and a closed end opposite the open end.

26. A method as claimed in claim 20, wherein the first part is configured to operate as a loop antenna comprising a first antenna end connected to the first feed point and a second antenna end connected to ground.

27. A method as claimed in claim 20, further comprising defining a second slot between the ground member and the third edge of the first conductive portion, the second slot having an open end adjacent the first edge of the first conductive portion, and a closed end, opposite the open end, the second slot having a second length.

* * * * *